US005171040A

United States Patent [19]

Orndorff

[11] Patent Number: 5,171,040

[45] Date of Patent: Dec. 15, 1992

[54] COPY-INVALIDATING DOCUMENT

[75] Inventor: Joseph E. Orndorff, Cincinnati, Ohio

[73] Assignee: Invisible Images, Inc., Cincinnati, Ohio

[21] Appl. No.: 677,151

[22] Filed: Mar. 29, 1991

[51] Int. Cl.[5] ..... B42D 15/00

[52] U.S. Cl. ..... 283/93; 283/74; 283/85; 283/58; 283/902; 428/916

[58] Field of Search ..... 283/93, 72, 74, 85, 283/57, 58, 902, 51; 428/916, 207

[56] References Cited

U.S. PATENT DOCUMENTS

| | | | |
|---|---|---|---|
| 4,168,088 | 9/1979 | Somlyody . | |
| 4,175,774 | 11/1979 | Tonges et al. . | |
| 4,210,346 | 7/1980 | Mowry, Jr. et al. . | |
| 4,227,719 | 10/1980 | McElligott et al. . | |
| 4,227,720 | 10/1980 | Mowry, Jr. et al. . | |
| 4,265,469 | 5/1981 | Mowry, Jr. et al. . | |
| 4,310,180 | 1/1982 | Mowry, Jr. et al. . | |
| 4,341,404 | 7/1982 | Mowry, Jr. et al. . | |
| 4,351,547 | 9/1982 | Brooks, II . | |
| 4,420,175 | 12/1873 | Mowry, Jr. | 283/93 |
| 4,579,370 | 4/1986 | Corwin et al. . | |
| 4,582,346 | 4/1986 | Caprio et al. | 283/93 |
| 4,891,666 | 1/1990 | Gordon | 283/72 |

FOREIGN PATENT DOCUMENTS

| | | | |
|---|---|---|---|
| 2191733 | 12/1987 | United Kingdom | 283/93 |

OTHER PUBLICATIONS

The Lithographers Manual, 8th Ed., 1988, Graphic Arts Technical Foundation, Inc., Chapter 11, "Platemaking", p. 9.

Research Project Report, 1965 (reprinted 1987), Graphic Arts Technical Foundation, Inc., "The GATF Dot Gain Scale" by Frank Preucil, Zenon Elyjiw and Robert F. Reed.

Xerox Information Disclosure, Mar. 1977.

*Primary Examiner*—P. W. Echols
*Assistant Examiner*—David P. Bryant
*Attorney, Agent, or Firm*—Fitch, Even, Tabin & Flannery

[57] ABSTRACT

The text discloses for use in printing valuable documents an allover pattern of warning indicia which is merged by human sensory perception with its background but is distinguished and reproduced by xerographic copying as a result of the employment of two different screen values for the indicia and the background which are respectively within and beyond the reproductive capability of the copier machine when used in the stated context. Adjunctively, document validating indicia are also printable on such documents in a screen value beyond the reproductive capability of xerographic copiers at the lighter settings at which the lesser screen value used for said warning indicia or background will reproduce.

16 Claims, 2 Drawing Sheets

COPY-INVALIDATING DOCUMENT

This invention relates to measures for detecting the unauthorized duplication of printed documents of value, such as checks or other financial instruments, stock certificates, coupons redeemable for value, academic transcripts, etc.

BACKGROUND OF THE INVENTION

The advent of xerography, and particularly color xerography, has provided the unscrupulous with the means for unauthorized duplication of original documents for the purpose of passing them off, with or without alteration, as an original document of the same kind. The problem is widespread, and well-known to the issuers of such original documentation, with the result that considerable attention has been given to ways and means to prevent the effective duplication of such documents by color xerography.

Out of such development, it has become understood that xerographic copiers have a screen value, or dot frequency, threshold above which the copier is unable to distinguish the individual elements of the dot pattern of halftone printing, and that, as to color xerography additionally, there are spectral ranges of color in which the reproductive capability of the copier is relatively impaired. These phenomena have been employed in various ways by those skilled in the printing art to foil the unauthorized xerographic duplication of valuable documents by causing invalidating indicia of tampering, essentially latent to the naked eye looking at the original document without the aid of magnification, to appear boldly in the xerographic copy.

Although the phenomena which make this form of document protection possible are generally known, the problem faced by all such methodology is to produce indicia of tampering which are truly latent in the original, even to the relatively low threshold of perception of the mere casual observer.

In most systems heretofore developed for the purpose, the indicia of tampering are printed in one dot frequency or screen value and the background in another, and the indicia camouflaged either with an intermediate third dot frequency immediately surrounding the warning indicia, or with a covering overlay of extraneous pattern, intended to confuse the eye sufficiently to render the warning indicia indiscernible to ordinary observation. While straightforward enough in concept, such systems tend to be complicated in execution, leaving a simpler but effective system to be desired.

SUMMARY OF THE INVENTION

This invention also is based upon the printing of the warning indicia and the background in different screen values, one above and one below the dot-frequency threshold of a xerographic copier, but presents the warning indicia as a compact allover pattern which serves as its own camouflage.

BRIEF DESCRIPTION OF THE DRAWINGS

The invention is described in the following specification by reference to the accompanying drawings, of which.

DESCRIPTION OF THE PREFERRED EMBODIMENT

Figure 1:
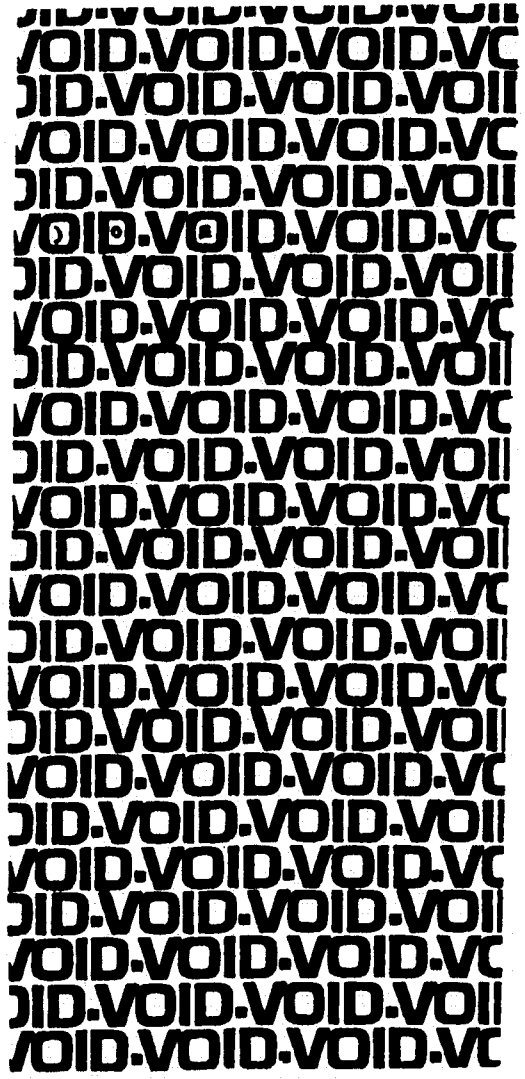
FIG. 1 is a compact allover pattern of warning indicia, specifically based on the word "VOID"
Figure 2:
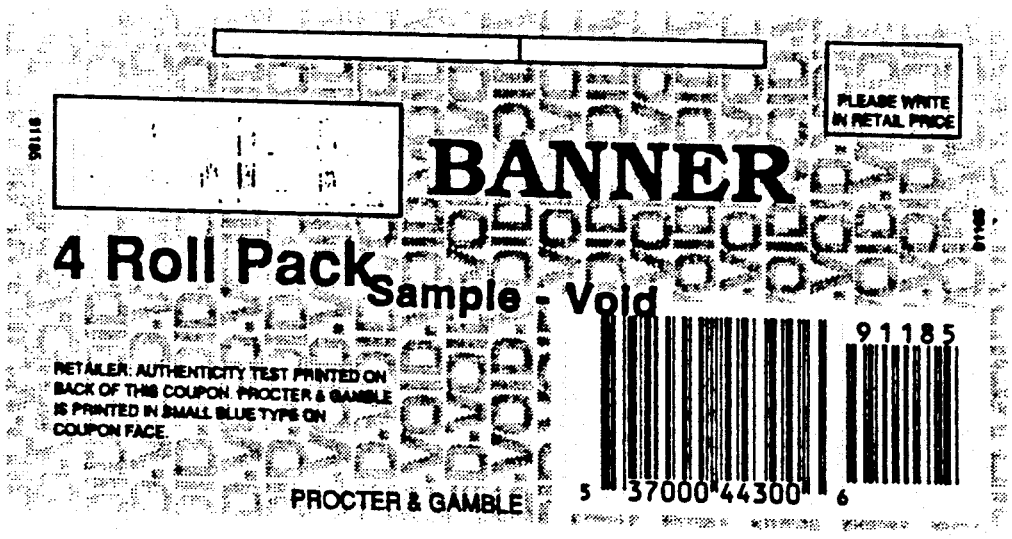
FIG. 2 represents a xerographic copy of an actual manufacturer's free-goods coupon utilizing the pattern of FIG. 1.

FIG. 1 of the drawings illustrates an overall pattern of warning indicia based upon the word "VOID" and printed in 24 point bold capitals which have been compressed within the lines from what would be regarded as normal proportional spacing, and compressed as well from line to line from customary spacing of successive lines of type. The overall size and proportion of document chosen for convenient illustration of the invention in FIGS. 1 and 2 is a common wallet size of financial document or instrument handled by the consumer, being, for convenience sake, roughly the size of the paper currency of the United States of America. It will be understood, however, that the invention is applicable equally to the protection of larger documents used for certificates of membership, ownership or debt, academic transcripts, etc., typically of letter-size and larger.

It should also be understood that while the "VOID" has been chosen as the illustrative warning indicia, other words of warning are equally usable, the word "COPY" being preferred for some applications.

Figure 3:
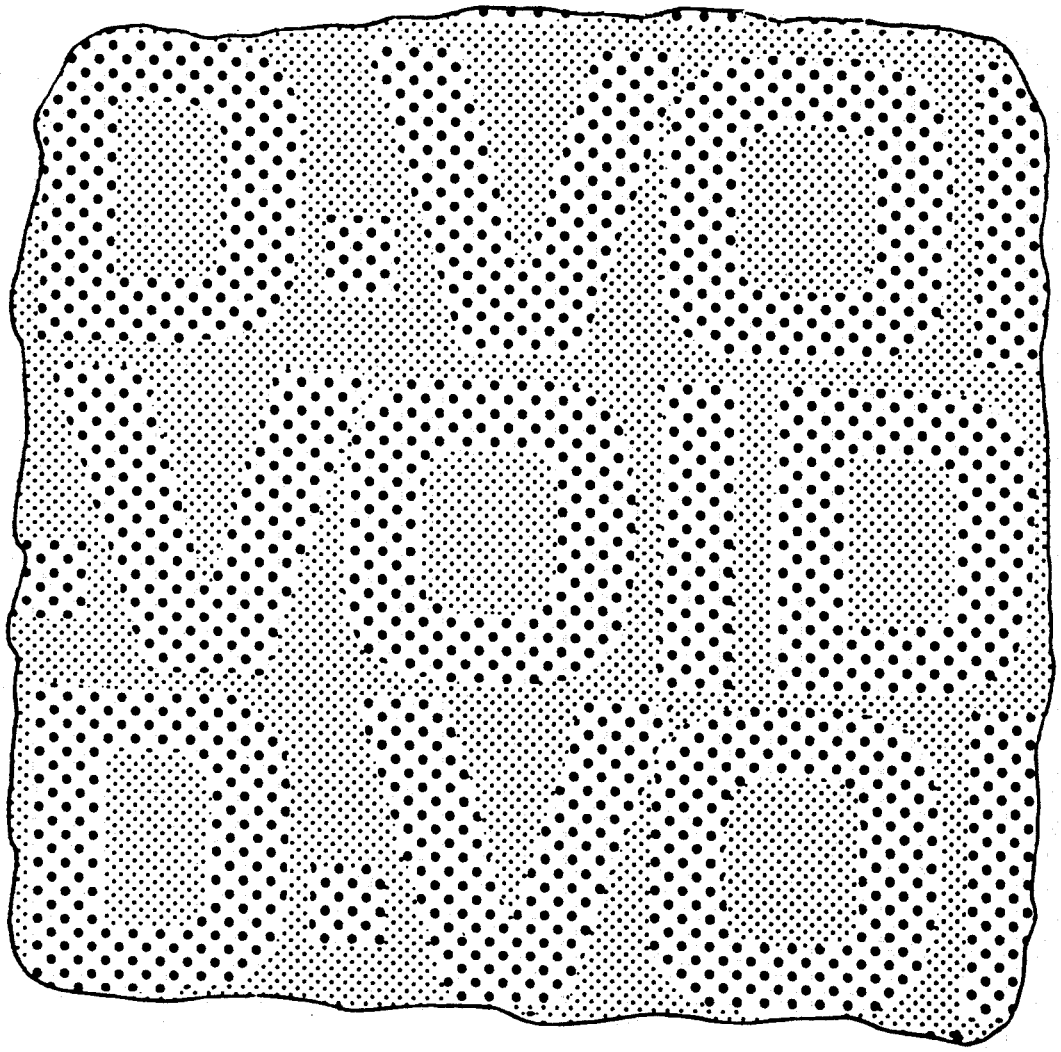
FIG. 3 is a much magnified fragmentary and diagrammatic representation of the original document of FIG. 2, intended to illustrate the relative dot frequencies of the screen values in which the warning indicia and background are printed.

For illustrative purposes, FIG. 1 shows the warning indicia pattern as solid rather than halftone characters on a blank or white background, but it will be understood by those skilled in the art that both the characters constituting the warning indicia, and also the background against which they appear, are printed in halftone for the purposes of the invention, as illustrated diagrammatically in FIG. 3, to which detailed reference will shortly be made.

FIG. 2 represents a xerographic copy of an actual manufacturer's coupon upon which the warning indicia of FIG. 1, normally indiscernible to the naked eye because of the sensory balance achieved between the warning indicia and the background against which they appear, have emerged boldly against a solid but lighter background. In the copy represented by FIG. 2, the dot frequency with which the characters of the warning indicia are printed is within the reproductive capability of the xerographic copier, whereas the background, printed with the same ink but with a dot frequency outside the reproductive capability of the copier, drops out because the resolution of the copier is inadequate to discriminate between the individual dots of the higher screen value selected for the background.

As will be noted from FIGS. 1 and 2, the warning indicia are preferably printed upon the usual paper substrate in lines perpendicular to the clearly readable text and illustrations of the document in order to render the pattern less recognizable for what it is.

The FIG. 3 diagram represents a much magnified fragment of the warning indicia pattern of FIG. 1 as printed on the actual document a xerographic copy of which is represented by FIG. 2. It illustrates in exaggerated scale, the printing of the characters themselves at a screen value of 65 lines per lineal inch, nominal, i.e., 65 lines of dots per inch on mutually perpendicular axes, preferably but not necessarily turned 45 degrees from the line of type. The background areas, in contrast, namely, the areas not actually covered by the characters of the warning indicia, including the spaces within as well as between the individual characters and between lines of characters, are printed at double the pitch, i.e., at a screen value of 133 lines per lineal inch, nominal.

The screen patterns are preferably in line registry along both mutually perpendicular axes. Moreover, the style, size, and spacing of the type are selected for minimum disruption of the dot patterns or distortion of the individual dots, such as might result either in discernible conflict, or in unprinted areas, at the edges of the characters. It will be observed, for example, referring to the style of type in the illustrative pattern, that the demarcation between the two dot frequencies is along a line of dots either on the two mutually perpendicular axes or along the 45 degree diagonals in the case of the letters "O" and "D". In the case of the letter "V", the lines of demarcation are aligned with dots along a secondary diagonal of the 65 line pattern with which the characters are printed, viz., at an angle of arc tangent 2 from one of the mutually perpendicular lines of dots, essentially without mutilation of any of the dots of the pattern.

It is believed that the indiscernibleness of the warning indicia to the naked eye may result from a combination of two effects, namely, a sensory balance of tonal values between the characters printed at 65 lines per inch and the background printed at 133 lines per inch, and the relative equality of areas occupied by the characters and their background resulting from the compression of the type. While it may not be possible to achieve precise geometric parity between the areas of the characters and the area of the background, an excellent result has been achieved in the preferred embodiment, constituting the warning "VOID", wherein it has been determined that the characters occupy approximately 53 percent of the total area occupied by a single repetitive increment. However, as those skilled in the printing art will understand, a sensory balance between the characters and their background, such as to cause them to merge indistinguishably, can be won or lost by varying the supply of ink with which they are being printed. This effect is attributable to differential dot gain, i.e., the differential increase of area between the dots of the two screen values employed, inasmuch as the individual dots of the finer mesh experience a larger percentage gain in printed area from a given increase in the ink supply. It is accordingly believed that a skilled pressman, by variation of the ink supply, should be able to render the printed warning indicia indiscernible to the naked eye, if the characters of the overall pattern occupy within 40 to 60 percent of the area of substrate which they occupy in total, and if the tonal values of the two dot patterns on the printing plate are such as to give the pressman the control to be able to produce a product wherein the two dot patterns have approximately equal tone density.

In the illustrated case, the warning indicia are revealed in FIG. 2 as a positive image of a dot pattern against a solid background of lighter color, or no color, indicating failure of the copying machine to reproduce the background of the original. The reverse or "negative" effect is equally feasible, i.e., with the characters printed at a screen value above that of the reproductive limit of the machine, while the background is printed at the screen value which renders it distinguishable to, and therefore reproducible by, the xerographic copier.

Although the illustrative example of FIGS. 1 and 2 employs 24 point bold capitals, compressed, the invention is not limited to a particular type size, and may employ type of other sizes within the criteria discovered to be enabling. In particular, while the use of the 65 dot screen value may pose practical lower limits of type size if the characters themselves are to be printed at that screen value, the use of type larger in size than 24 point is feasible as long as the area ratios of warning indicia to background are maintained. No actual upper type size limit has been ascertained, but practicality will obviously dictate some relation to the size of the actual document in order to assure the sufficient recurrence of legible warning indicia in the xerographic copy. A compressed type warning indicia printed in 76 point bold characters has been employed successfully in documents of conventional U.S. business document size, i.e., 8½ by 11 or 13 inches.

The phenomena involved in exposing by xerography images essentially latent in the original document are relatively independent of the color of the original. Good results have been obtained with dark inks of blue, red, green, brown, and variants thereof, using the standard process inks Where press facilities or usage will accommodate nonstandard inks, the use of inks with black pigment in their formulations recommends itself inasmuch as such inks seem to enhance the latency of the image in the original. In either case, a good result has been achieved with plates made from film screens utilizing the 65 and 133 line combination at a density or nominal area coverage by the dots within the patterns within the range of 12 to 14 percent and 9 to 11 percent, respectively, measured on a MacBeth densitometer. At these dot frequency and tone density values, together with the compression of the type of the warning indicia into approximate area parity with the background, it is well within the ability of the skilled pressman to achieve the sensory balance which allows the warning indicia visually to become one with the background in an original document embodying this invention i.e., to achieve the latency of the warning indicia solely by the printing of the indicia and background, without resort to further camouflage measures.

In a further aspect of the invention designed to protect the document against attempted copying at very light copier settings intended to cause the warning indicia themselves to drop out or disappear by loss of the larger dot print as well, document data essential to its validity are also printed in halftone, preferably at least of the pitch or dot frequency chosen, in the illustrated case, for the background between and within the characters of the warning indicia. These validating data, such as the words "FREE", the legend "Manufacturer's Coupon", and the expiration date seen in FIG. 2, or at least some of them, are preferably isolated in an otherwise unprinted area of the substrate, where the person inspecting the document for validity cannot fail to notice the absence of essential data clearly legible on valid copy, and where, being isolated, they may readily be printed in a color other than that used for the warning indicia patterns.

In the printing of monocolor documents, good results have been achieved by printing such essential data on an otherwise unprinted area of white or light-colored substrate with the screen value or pitch chosen for the background of the overall pattern of warning indicia, namely, in the illustrative example, a dot frequency of 133 lines per inch, nominal, at 10 percent tone density. This pitch may be increased, if desired, to 150 lines per inch, for example, as additional protection against the reputedly greater resolving power of laser color copiers, but tests have shown that even the more sophisticated copiers in general use at the present time will, at lighter settings, "lose" the essential validating data printed in either 130 or 150 lines while the warning indicia at 65 lines are still legible.

The features of the invention believed new and patentable are set forth in the following claims.

What is claimed is:

1. A printed document incorporating a latent image of indicia chosen to thwart reproduction of the document by xerographic copying by causing said latent image to reveal itself in xerographic copies of the document, comprising:

a printable substrate, a warning notice comprising selected cancellation indicia printed upon the substrate at a first screen value in an allover repetitive pattern of characters in the area of the substrate in which said indicia are employed, and a background printed upon the substrate at a second screen value in all of said area not occupied by the characters constituting said indicia, one of said first and second screen values being reproducible as a dot pattern by xerographic copiers and the other screen value being beyond the dot resolving power of such copiers, and wherein the latency of the cancellation indicia is achieved solely by said cancellation indicia and said background.

2. A printed document according to claim 1 wherein said allover repetitive pattern of characters is compressed to a degree such that the portion of said area of the substrate printed in the screen value employed for said substrate occupies at least 40 percent of said area of the substrate.

3. A printed document according to claim 1 wherein said first screen value is that screen value which is reproducible by xerographic copiers.

4. A printed document according to claim 1 which incorporates visible type indicating normal reading orientation of the document, and wherein said warning notice runs perpendicularly to the visible type appearing thereon.

5. A printed document according to claim 1 wherein said first screen value is approximately 65 lines per inch and said second screen value is approximately double the first, and the characters are presented in lines of type and are spaced within each line of type and between lines of type so as to occupy substantially half of said area of the substrate.

6. A printed document according to claim 5 wherein the characters are printed in bold capitals of uniform size in the range of from 24 to 76 point.

7. A printed document incorporating a latent image of indicia chosen to thwart reproduction of the document by xerographic copying by causing said latent image to reveal itself in xerographic copies of the document, comprising:

a printable substrate, a warning notice comprising selected cancellation indicia printed upon the substrate at a first screen value in an allover repetitive pattern of characters in the area of the substrate in which said indicia are employed, and a background printed upon the substrate at a second screen value in all of said area not occupied by the characters constituting said indicia, one of said first and second screen values being reproducible as a dot pattern by xerographic copiers and the other screen value being beyond the dot resolving power of such copiers, and wherein the tone densities of said cancellation indicia and said background are substantially equal.

8. A printed document according to claim 11 wherein said allover repetitive pattern of characters is compressed to a degree such that the portion of said area of the substrate printed in the screen value employed for said characters occupies at least 40 percent of said area of the substrate.

9. A printed document according to claim 11 wherein said first screen value is that screen value which is reproducible by xerographic copiers.

10. A printed document according to claim 11 which incorporates visible type indicating normal reading orientation of the document, and wherein said warning notice runs perpendicularly to the visible type appearing thereon.

11. A printed document according to claim 11 wherein said first screen value is approximately 65 lines per inch and said second screen value is approximately double the first, and the characters are presented in lines of type and are spaced within each line of type and between lines of type so as to occupy substantially half of said area of the substrate.

12. A printed document according to claim 11 wherein the characters are printed in bold capitals of uniform size in the range of from 24 to 76 point.

13. A printed document according to claim 1 or claim 11 further including legible validating indicia printed thereon in areas not occupied by said cancellation indicia, said validating indicia being printed at a screen value sufficiently greater than the lesser screen value of said first and second screen values to cause the validating indicia to disappear from xerographic copies of said document at lighter machine settings at which said lesser screen value is reproduced.

14. A printed document according to claim 13 wherein said validating indicia are printed upon a blank area of the substrate.

15. A printed document according to claim 13 wherein said validating indicia are printed in a color different from that used for the cancellation indicia and their background.

16. A printed document according to claim 13 wherein said validating indicia and said cancellation indicia are printed in the same color.

* * * * *

UNITED STATES PATENT AND TRADEMARK OFFICE
CERTIFICATE OF CORRECTION

PATENT NO. : 5,171,040

DATED : December 15, 1992

INVENTOR(S) : Joseph E. Orndorff

It is certified that error appears in the above-identified patent and that said Letters Patent is hereby corrected as shown below:

Title Page, "References Cited, U.S. Patent Documents", in the "Mowry, Jr., Patent No. 4,420,175" reference, change "12/1873" to --12/1983--.

Column 2, line 29, after "the" insert --word--.

Column 2, line 64, after "document" insert a comma.

Column 4, line 26, after "inks" insert a period.

Column 4, line 42, after "invention" insert a comma.

Column 5, line 39, change "substrate" to --characters--.

Column 5, line 41, change "claim 1" to --claims 1 or 2--.

Column 6, line 18, change "11" to --7--.

Column 6, line 24, change "11" to --7--.

Column 6, line 27, change "11" to --7--.

Column 6, line 32, change "11" to --7--.

Column 6, line 43, change "11" to --7--.

Signed and Sealed this

Twenty-third Day of November, 1993

Bruce Lehman

*Attest:*

BRUCE LEHMAN

*Attesting Officer*

*Commissioner of Patents and Trademarks*